US009097419B2

(12) United States Patent
Zatti et al.

(10) Patent No.: US 9,097,419 B2
(45) Date of Patent: Aug. 4, 2015

(54) PREMIX GAS BURNER

(75) Inventors: Claudio Zatti, Sorbolo (IT); Raffaello Rastelli, Sorbolo (IT); Nicola Lovascio, Reggio Emilia (IT)

(73) Assignee: Gas Point S.R.L. (IT)

( * ) Notice: Subject to any disclaimer, the term of this patent is extended or adjusted under 35 U.S.C. 154(b) by 627 days.

(21) Appl. No.: 12/990,469

(22) PCT Filed: Apr. 29, 2009

(86) PCT No.: PCT/IB2009/005414
§ 371 (c)(1),
(2), (4) Date: Jan. 24, 2011

(87) PCT Pub. No.: WO2009/133451
PCT Pub. Date: Nov. 5, 2009

(65) Prior Publication Data

US 2011/0139045 A1 Jun. 16, 2011

(30) Foreign Application Priority Data

Apr. 30, 2008 (IT) ..... BO2008A0278

(51) Int. Cl.

| | |
|---|---|
| ***F23D 14/62*** | (2006.01) |
| ***F23D 14/60*** | (2006.01) |
| ***F23D 14/64*** | (2006.01) |
| ***F23N 1/02*** | (2006.01) |
| ***F23N 5/24*** | (2006.01) |

(52) U.S. Cl.
CPC ..... *F23D 14/60* (2013.01); *F23D 14/64* (2013.01); *F23N 1/022* (2013.01); *F23N 5/242* (2013.01); *F23D 2900/00003* (2013.01); *F23D 2900/14642* (2013.01)

(58) Field of Classification Search
CPC ..... F23D 14/60; F23D 14/62; F23N 1/022; F23N 1/027; F23N 1/047; F32D 14/62; F32D 14/08; G01F 1/44; F02M 2700/4319; F02M 2700/4314; F02M 2700/4397
USPC ..... 431/354, 89, 62, 18, 191–193; 417/151; 261/23.2; 239/419.5, 410, 408; 110/188
See application file for complete search history.

(56) References Cited

U.S. PATENT DOCUMENTS

| | | | | |
|---|---|---|---|---|
| 1,152,031 | A * | 8/1915 | Lobdell | 261/41.3 |
| 2,271,690 | A * | 2/1942 | Goffredo | 251/48 |
| 2,770,254 | A * | 11/1956 | Bolton | 137/625.48 |
| 4,861,261 | A | 8/1989 | Krieger | |
| 6,604,938 | B1 * | 8/2003 | Blaauwwiekel et al. | 431/18 |
| 7,410,152 | B2 * | 8/2008 | Yates | 261/23.2 |
| 2003/0077551 | A1 * | 4/2003 | Zia et al. | 431/354 |

FOREIGN PATENT DOCUMENTS

| | | | |
|---|---|---|---|
| DE | 29711889 | U1 | 11/1997 |
| DE | 19635974 | A1 | 3/1998 |

(Continued)

*Primary Examiner* — Avinash Savani
*Assistant Examiner* — Vivek Shirsat
(74) *Attorney, Agent, or Firm* — Blank Rome LLP

(57) ABSTRACT

An air/gas premix burner, comprising:
- a fan for sending the air/gas mixture to a combustion head;
- a gas valve for regulating admission of the combustible gas;
- an air/gas mixer, which comprises a device for localized loss of pressure; and
- a combustion head.

The premix burner is characterized in that the air/gas mixer comprises at least two channels for mixing the air with the gas; in addition, a channel is provided with an open/close element designed to regulate the flow rate of the mixture.

10 Claims, 5 Drawing Sheets

(56) References Cited

FOREIGN PATENT DOCUMENTS

| | | | |
|---|---|---|---|
| DE | 10119598 | A1 | 10/2002 |
| EP | 0559280 | A1 | 9/1993 |
| WO | 0210645 | A2 | 2/2002 |

* cited by examiner

PREMIX GAS BURNER

CROSS-REFERENCE TO RELATED APPLICATIONS

The present application is the U.S. National Phase of PCT/IT2009/005414, filed Apr. 29, 2009, Published on Nov. 5, 2009, as WO2009/133451A2, which claims the benefit of Italian Patent Application No. BO2008A000278, filed Apr. 30, 2008. The disclosures of the above-referenced applications are hereby incorporated by reference in their entireties into the present disclosure.

TECHNICAL FIELD

The present invention relates to a premix gas burner with total premixing of gas/air.

BACKGROUND ART

As is known, premix burners with total air/gas premixing are today widely used for producing thermal energy in gas boilers.

The use of these burners is rapidly spreading replacing traditional atmospheric burners in so far as, as compared with the latter, they enable:

[A] lower emissions of pollutant substances (nitrogen and carbon oxides);

[B] high heat-exchange efficiency at all thermal-power regimes and in particular at the minimum thermal power; and

[C] high modulation range between the maximum and the minimum thermal power of the burner.

Air/gas premix burners are today prevalently obtained using the following essential components:

- a fan for delivery of the air/gas mixture to a combustion head;
- a gas valve actuated pneumatically equipped with a flow regulator;
- an air/gas mixing system constituted by a Venturi tube or by a diaphragm performing a similar function (see hereinafter); and
- a combustion head provided with the device for ignition of combustion of the air/gas mixture.

In these systems, the active device (also referred to as "driver") is represented by the fan, which, being supplied electrically in an appropriate way, delivers the combustion air to the burner in an amount directly proportional to the thermal power that it is intended to supply to the burner and hence to the thermal power of the head of the burner.

The passive device (also referred to as "follower") is represented by the gas valve, which is able to supply gas in an amount directly proportional to the amount of air blown into the system thanks to the regulation system illustrated hereinafter.

The gas valves are characterized in that, irrespective of the value of the pressure of the incoming gas (obviously, within the limits of work allowed by the valve itself and corresponding to the pressures of distribution of the mains-supply gas), they supply gas at output at a pressure equal to the pressure exerted on their "regulator".

Explained in greater detail hereinafter are the aforesaid general concepts with reference to the attached figures, where:

FIG. 1 illustrates a first embodiment of a traditional premix burner; and

FIG. 2 shows a second embodiment of a premix burner of a known type.

In a burner 10 illustrated in FIG. 1 an air/gas mixer of a Venturi-tube type 11 is set downstream of a fan 12 with respect to an air flow (AF). The mixer 11 comprises a device for localized pressure loss 11A, in this case constituted by a Venturi tube.

Connected upstream of the Venturi-tube air/gas mixer 11 is a conduit 13 that sends a pressure signal P1 to a gas valve 14. In addition, entering the gas valve 14 is a flow of gas (FG) at the mains-supply pressure Po.

The amount of gas released by the gas valve 14 to the mixer 11 is correlated to the pressure difference existing between a pressure P2 at output from the gas valve 14 (pressure P2 equal to the value of the pressure P1) and a pressure P3 existing in the narrowest point (localized-pressure-loss device 11A) of the Venturi-tube air/gas mixer 11.

A flow regulator 15 set on a tube 16 for connection between the gas valve 14 and the Venturi-tube air/gas mixer 11 enables regulation of the amount of gas supplied so as to have an optimal air/gas ratio for combustion of the mixture in a combustion head (TC).

The system, once calibrated through adjustment of the flow regulator 15, enables a constant air/gas ratio to be obtained throughout the operating range of the burner 10.

It is evident, in fact, that, for any value of air flowrate generated by the fan 12, the pressure difference (P1–P3), generated by the air flowrate, and measured between the inlet and the narrowest section of the Venturi-tube air/gas mixer 11, will be the same as the one that will generate the rate of gas coming out of the gas valve 14, given that the Venturi-tube air/gas mixer 11 is a rigid and undeformable mechanical member.

The gas/air mixture is sent according to a flow (MF) towards the combustion head (TC). The burner 10 is completed by a device 17 for ignition of the flame and detection of the presence thereof, and by an electronic control unit (CNT), which controls operation of the fan 12, of the gas valve 14, and of the device 17 itself.

In a second embodiment known in the prior art and illustrated in FIG. 2, the Venturi-tube air/gas mixer 11 is located upstream of the fan 12.

It should be said incidentally that, in the second embodiment of FIG. 2, the same numbering of FIG. 1 has been used for designating elements that are identical or similar to the ones appearing in FIG. 1.

In this second embodiment the type of pressure signal P1* coincides with the atmospheric pressure Pa that acts simultaneously on the regulator 15 of the gas valve and in the inlet mouth of the Venturi-tube air/gas mixer 11.

The amount of gas released by the gas valve 14 is correlated to the pressure difference existing between the output pressure P2* (equal, in this case, to the atmospheric pressure Pa and to the pressure P1*) and the pressure P3* existing in the narrowest point of the Venturi-tube air/gas mixer 11.

Also in this case, the flow regulator 15 set on the conduit 16 for connection between the gas valve 14 and the Venturi-tube air/gas mixer 11 enables regulation of the amount of gas supplied so as to have an optimal air/gas ratio for combustion.

The system, once calibrated by means of the regulator 15, enables a constant air/gas ratio to be obtained throughout the operating range of the burner 10.

It is evident, in fact, that for any value of air flowrate generated by the fan 12 the pressure difference (Pa–P3*) (with Pa equal to the ambient pressure) generated by the air flow (AF) and measured between the inlet and the narrowest section of the Venturi-tube air/gas mixer 11 will be the same that generates the flowrate of gas coming out of the gas valve 14.

In actual fact, in order to improve combustion, the air/gas ratio is purposely not kept rigorously constant throughout the modulation range, but is varied by a few tenths of percentage point.

However, given that this variation is very small, it is altogether of no effect for the purposes of the present treatment.

A possible variant (not illustrated) with respect to both of the systems illustrated in FIGS. 1 and 2 is represented by the use of diaphragms as an alternative to the use of an air/gas mixer of a Venturi-tube type.

However, premix burners of the types described with reference to FIGS. 1 and 2 present the following disadvantages:

- a modulation range that varies from 100% to 20% (ratio 1:5) of the nominal thermal power; and
- high losses of head at the maximum thermal power.

Consequently, the need has been felt to:

- increase the modulation range so as to reach minimum values of 10% (ratio 1:10) and even lower; and
- reduce the losses of head of current mixing systems.

The first requirement arises from the fact that the premises to be heated present ever lower heat dispersions, whereas users have increasingly higher needs of comfort for production of hot water for sanitary purposes.

In addition, as has been said, there is an increasingly widespread use of boilers of a combined type (also referred to as "boilers of a combi type"), i.e., ones that are able to supply heat to the water of the heating system and, when required, to the hot water for sanitary uses.

This type of boiler must have, however, the capacity to supply continuously (i.e., without any turning-off of the burner) energy to a markedly differentiated extent, i.e., a very high extent for the production of water for sanitary purposes and a very limited extent for the production of heat for the heating system.

It is known, in fact, that the operation of a burner of an intermittent type is a source of dispersions of energy for managing transient phases of startup and turning-off (preventilation and/or postventilation for safety requirements) in addition to the emission of pollutants in the ignition step.

The modulation range is currently limited by some physical and technological limits of the systems, which can be summarized as follows:

- the fans currently in use are able to function properly in a range comprised between 1000 and 6000 r.p.m.; above 6000 r.p.m. the efficiency of the fans drops drastically, whilst the problems of noise generated by the moving parts (impellers, bearings, air flow, etc.) increase considerably; furthermore, below 1000 r.p.m. the problems of stability of the velocity of rotation of the fan increase considerably, with consequent problems of combustion; in addition
- the gas valves are currently able to function properly with values of pressure at input to the regulator of higher than 30÷40 Pascal.

Below these values the problems of repeatability of the value of pressure at output from the gas valve increase considerably, with consequent marked variations in the air/gas ratio and hence with problems of flame lifting from the combustion head or of low level of combustion hygiene.

If we keep the minimum velocity of the fan referred to above constant, the Venturi tubes (or the diaphragms) are able to supply differences of pressure higher than the minimum ones required for the gas valves only on the condition of having a very small minimum section of passage. Consequently, even by pushing the fans to the maximum speeds allowed the maximum air flowrates that can be obtained (and hence, in the ultimate analysis, the maximum achievable thermal powers) are limited to not more than 5÷6 times the values of thermal power obtained at the minimum speed.

The second requirement of the users derives from the fact that it is possible to use in the production of the burner fans with lower performance and hence less costly given the same achievable modulation ratio.

In particular, the present invention finds advantageous, though non-exclusive, application in combination with a combined boiler for simultaneous or differed production of water for heating premises and of hot water for sanitary purposes.

DISCLOSURE OF INVENTION

Consequently, the aim of the present invention is to provide a premix burner which will be free from the drawbacks described above and, at the same time, will be easy and inexpensive to produce.

Hence, provided according to the present invention is a premix burner in accordance with the annexed claims.

BRIEF DESCRIPTION OF THE DRAWINGS

The present invention will now be described with reference to the annexed drawings, which illustrate three non-limiting examples (in FIGS. 3-5) of an embodiment thereof, in which.

BEST MODE FOR CARRYING OUT THE INVENTION

Figure 1:
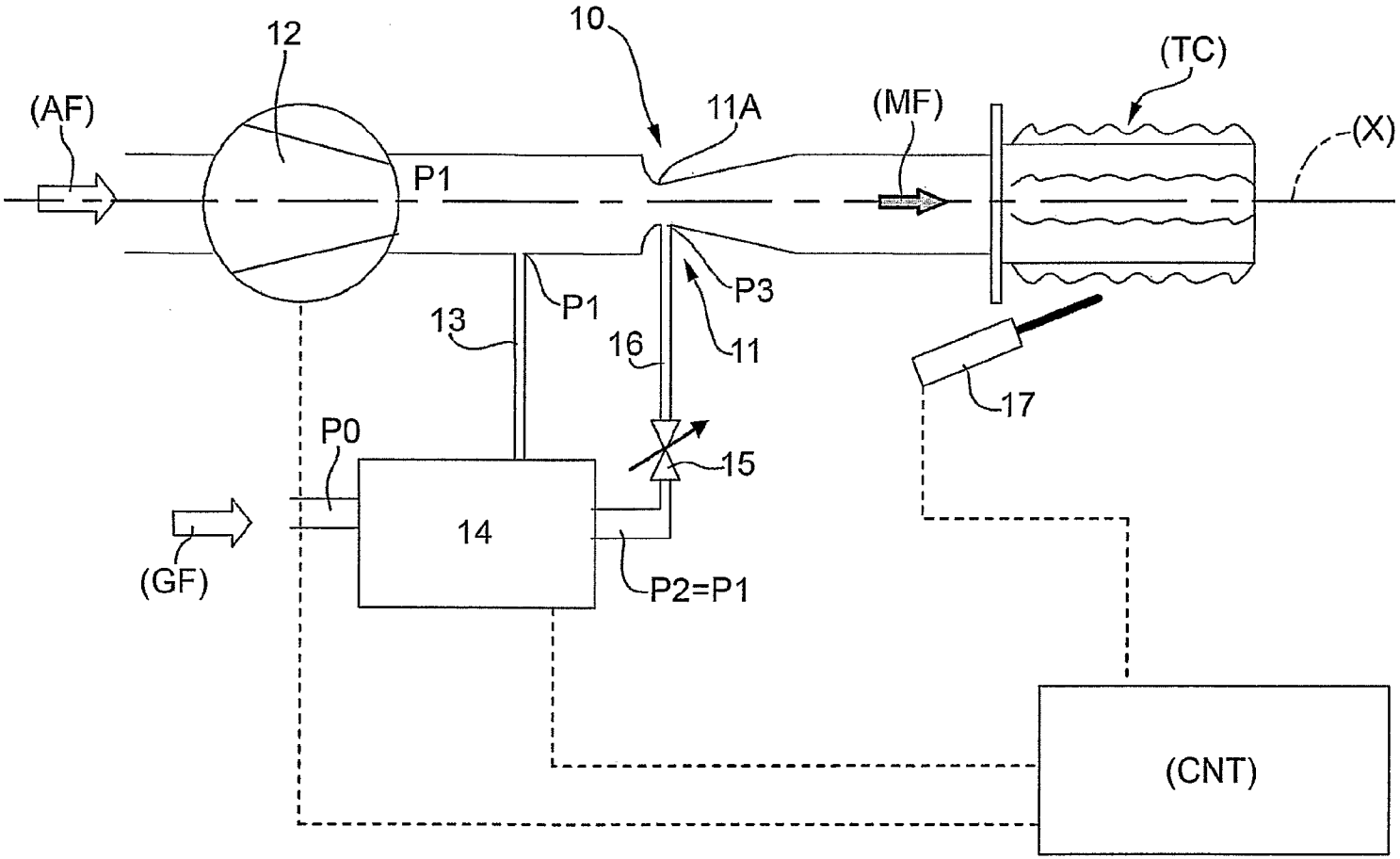
FIG.1 PRIOR ART
FIG. 1 illustrates a first embodiment of a traditional premix burner.
Figure 3:
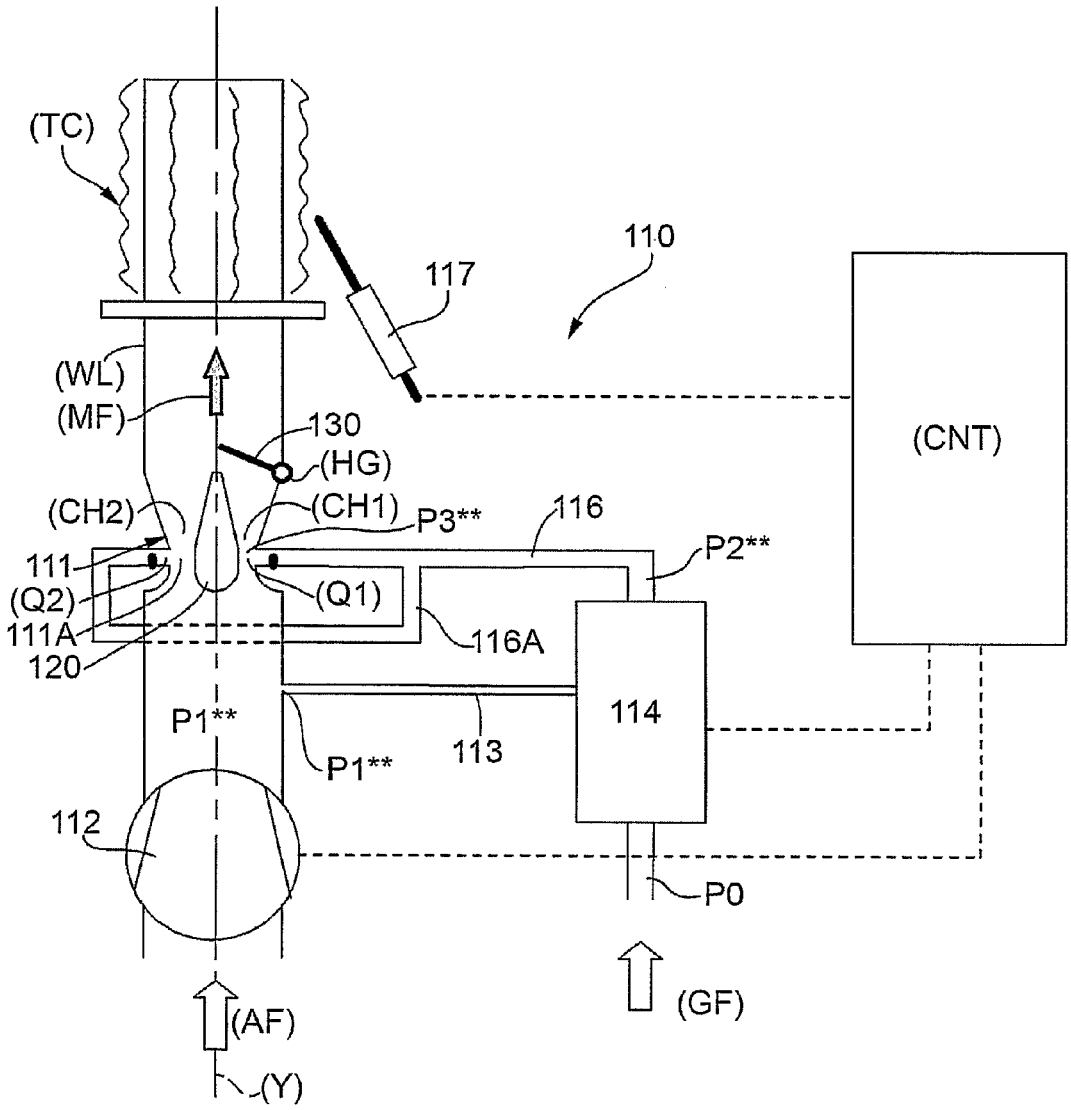
FIG. 3 is a schematic illustration of a first embodiment of the premix burner forming the subject of the present invention.

The diagram of FIG. 1 must be considered as the starting point for the first embodiment of the present invention illustrated in FIG. 3.

Consequently, in the diagram of FIG. 3 the elements that are identical or similar to the ones already described have been numbered by adding the number 100 to the numbering used in FIG. 1.

For reasons of concision, the various elements comprised in the burner 110 with vertical axis (Y) will not be described again in detail.

A characterizing element of the embodiment illustrated in FIG. 3 is constituted by the fact that the Venturi-tube air/gas mixer 111 is divided into two channels (CH1), (CH2) by a baffle element 120.

The dimensions of the minimum sections of the channels (CH1, CH2) for mixing of the fluids are the same as one another so as to generate, given the same air flow passing through, the same pressure difference.

As an alternative to what has been seen in the previous point, the dimensions of the minimum sections of the channels (CH1, CH2) for mixing of the fluids can be different so as to generate, given the same flow of air passing through, a different and preset pressure difference.

Said baffle element 120 is shaped in such a way as to bestow upon each channel (CH1), (CH2) the shape of a Venturi tube.

In addition, the channel (CH1) shaped like a Venturi tube, is closed according to laws that will emerge more clearly from what follows, by an open/close element 130 constrained to a wall (WL) of the burner 110 by means of a hinge (HG).

Consequently, one of the subjects of the present invention is constituted by a premix burner 110 with two or more Venturi tubes having the capacity of:

generating high differences of pressure (P1–P3**) at the minimum flowrate of the air or of the air/gas mixture without generating high fluid-dynamic resistances at the maximum flow rate; or else generating low fluid-dynamic resistances of the system at the maximum flowrate of the fluid generating sufficient differences of pressure (P1**–P3****) at the minimum flowrate of the fluid.

This characteristic is obtained by fitting on the outlet mouth of all the Venturi tubes except one open/close elements having a weight and shape adequate for opening the passage for the air/gas mixture in the desired conditions according to the principles listed below.

[A] When the flowrate of air or of air/gas mixture is maximum, the open/close element 130 opens under the dynamic thrust exerted by the moving fluid mass, offering a negligible resistance to its passage; in this condition, the multiple Venturi tube behaves exactly like a single Venturi tube.

[B] Provided that the sections of passage of the fluid are the same as one another, that their sum is equal to the section of the single Venturi tube, and that the total flowrate of fluid is the same, the pressure difference (P1–P3****) generated by the individual Venturi tubes of the multiple system is the same as the one generated by the single Venturi tube.

[C] In effect, the resistance of the system with multiple Venturi tube is slightly higher than that of the corresponding system with a single Venturi tube; however, it is higher by a negligible amount with respect to the high pressures generated by the fan operating at high rates of rotation of the impeller.

[D] When the flowrate of air or of air/gas mixture is minimum, the open/close elements 130 close under the action of the weight of the open/close elements 130 themselves, the thrust exerted by the moving fluid mass vanishing almost totally.

[E] In these conditions only the Venturi tube that is less unfavoured remains operative since it is without an open/close element on the outlet mouth.

We shall now analyse from the fluid-dynamic standpoint the case with two channels (CH1), (CH2) (FIG. 3), each of which forms a Venturi tube.

As compared to the single Venturi tube (of a total section equal to twice that of the single Venturi tube that has remained operative) the flowrate is twice as much, hence, the speed is twice as much and, in the final analysis, the pressure difference (P1–P3****) is four times as much, owing to the known principles of physics.

Since it is possible to generate such high differences of pressure at the minimum flowrates of fluid, it is possible, given the same gas valve 114 available, to reduce to one quarter the minimum flowrate of gas to the mixer as compared to the known art based upon the single Venturi tube.

Consequently, it is possible to pass from the current modulation ratios of 1:5 to 1:6 to theoretical values of 1:20 to 1:24; and practical values (taking into account the increase in the fluid-dynamic resistance consequent upon the presence of the open/close elements) of 1:15 to 1:18.

The weight of the open/close element 130 is determined so as to enable closing of the channel (CH1) before the pressure difference (P1–P3****) drops to values lower than the ones tolerated for proper actuation of the gas valves.

Obviously, passing to a system, for example, with three Venturi tubes (two of which with open/close element) it is possible to pass from the current ratios of 1:5÷1:6 to theoretical values of 1:45÷1:54 and to practical values of 1:30÷1:36.

In this case, the weight of the two open/close elements is different and is determined so as to enable closing of the first outlet mouth of the Venturi tube, and subsequently of the second outlet mouth of the Venturi tube, before the pressure difference (P1–P3**) drops to values lower than the ones tolerated for proper operation of the gas valves 114**.

It is evident how the passage from the position of open/close element completely open to that of open/close element completely closed is gradual and progressive and does not determine, given the same dimensions of the sections of passage in the different Venturi tubes, any alteration of the air/gas ratio of the mixture coming out of the Venturi tubes that have remained open, since this ratio is determined by the dimension of the input section and of the minimum section of the Venturi tube itself and since these are evidently fixed.

When the main need is not to increase the modulation ratio but is to reduce the overall resistance of the system at the maximum thermal power all the considerations made so far remain valid, with the fundamental difference that all the considerations made must be applied to Venturi tubes having minimum sections of passage that are wide so as to reduce the total loss of head of the system.

Working backwards through the previous considerations it is evident that to obtain a final modulation ratio of 1:5 it is sufficient to start from Venturi tubes having minimum sections of passage such as to achieve individually modulation ratios of 1:1.7.

In addition, when the open/close element 130 is completely closed, in a gas-inlet section (Q1) at the minimum section of the Venturi tube corresponding to the channel (CH1), instead of having a negative pressure with respect to the pressure P1 of the air-inlet section, there is, instead, the same pressure P1****.

This determines a negligible air flow in a conduit 116A towards a gas-inlet section (Q2) in the Venturi tube corresponding to the other channel (CH2) without open/close element, provided that the gas-inlet sections (Q1), (Q2) in the mixing system 111 are configured in such a way as to create the fluid-dynamic resistance necessary to obtain the proper air/gas ratio.

In actual fact, there may be a number of gas-inlet sections (Q1), (Q2), even though in the attached figures only two of them are illustrated.

It is once again pointed out that the amount of recirculation air that flows in the conduit 116A is negligible provided that the gas-inlet sections (Q1), (Q2) are small to an extent such as to avoid the use of the gas-flow regulator (choke/nozzle/diaphragm) and so as to cause the sections (Q1), (Q2) themselves to perform the function of flow regulator.

In this way, in fact, since that the gas valve 114 supplies at outlet a gas pressure P2 equal to the pneumatic pressure at inlet P1**, the air upstream and downstream of these gas-inlet sections (Q1), (Q2**) is at the same pressure.

Finally, we shall analyse by way of example the case of a system with just two channels different from one another in which the channel CH1 (provided with open/close element) has a minimum section of passage slightly smaller than that of the channel CH2.

The pressure difference (P1-P3) is lower in the channel CH2 than in the channel CH1 and this determines, given the same gas-inlet sections (Q1), (Q2), a lower flowrate of gas through the inlet (Q2), and hence a slight impoverishment of the gas/combustion-air mixture at the minimum power, improving the combustion hygiene at the head of the burner (TC) in those conditions.

Figure 4:
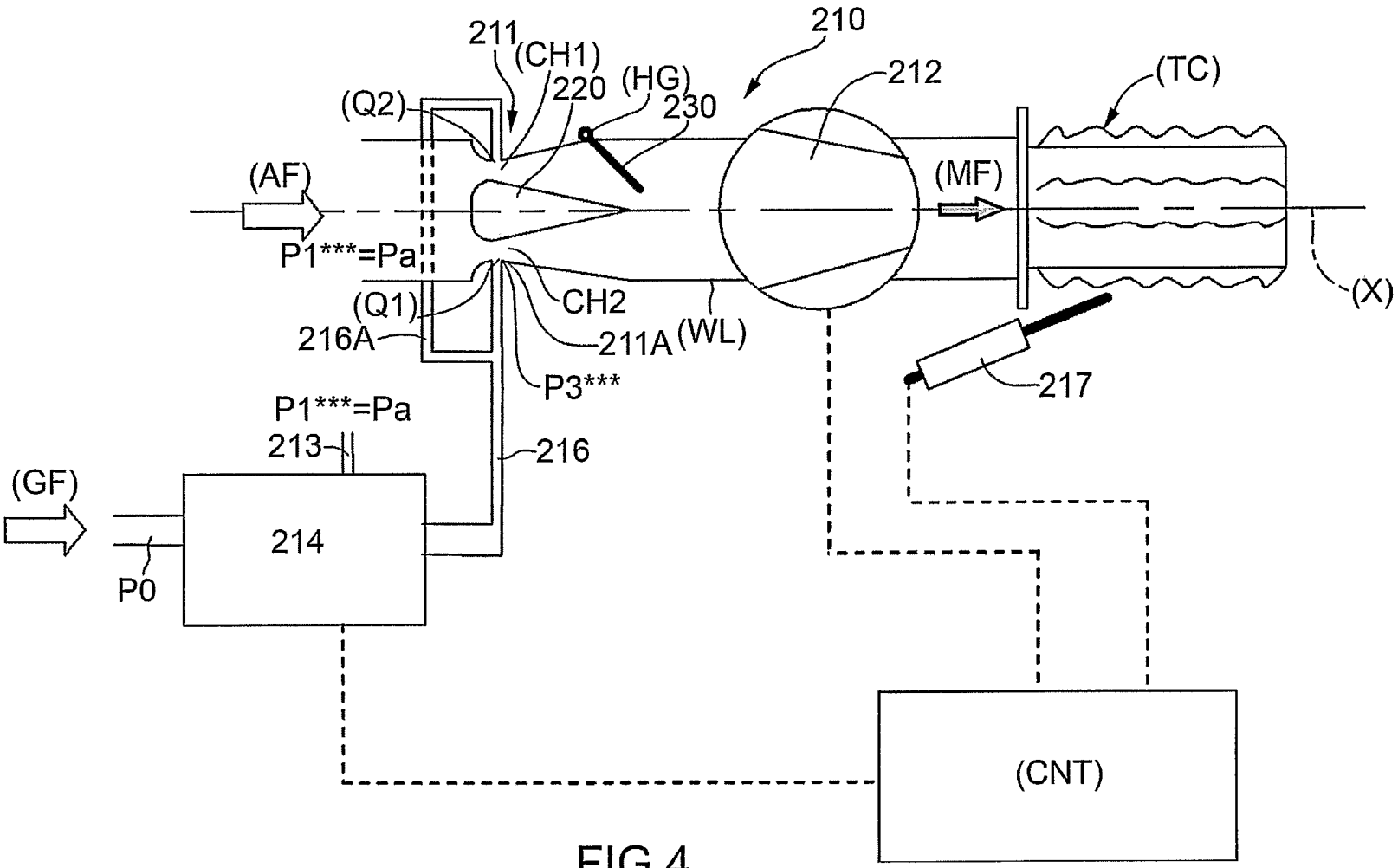
FIG. 4 is a schematic illustration of a second embodiment of the premix burner forming the subject of the present invention.

Represented in FIG. 4 is a second embodiment of a premix burner with horizontal axis (X).

In addition, the premix burner can present an axis inclined by any desirable amount with respect to a horizontal (X) or vertical (Y) axis.

Figure 2:
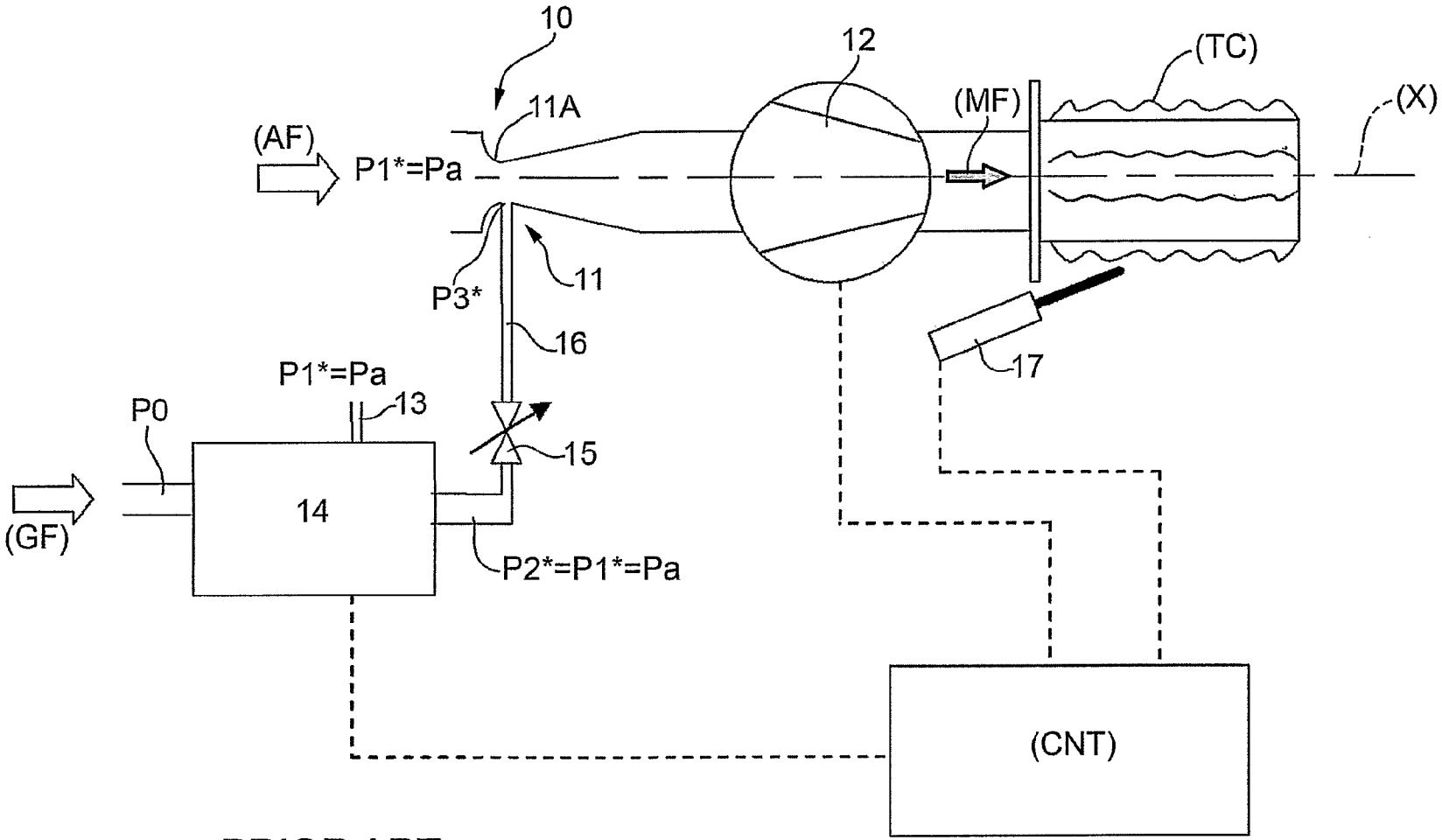
FIG.2 PRIOR ART
FIG. 2 shows a second embodiment of a premix burner of a known type.

The diagram of FIG. 2 (with fan set downstream of the area of mixing) is to be considered the starting point for the second embodiment of the present invention illustrated in FIG. 4.

Consequently, in the diagram of FIG. 4 the elements that are identical or similar to ones already described have been numbered by adding the number 200 to the numbering used in FIG. 2.

For reasons of concision we shall not describe again in detail the various elements comprised in the burner 210 with horizontal axis (X).

A characterizing element of the embodiment illustrated in FIG. 4 is represented by the fact that the Venturi-tube air/gas mixer 211 (with a localized-pressure-loss device 211A) is divided into two channels (CH1), (CH2) by a baffle element 220. The open/close element 230 is constrained to the wall (WL) of the burner 210 by means of a hinge (HG).

Also in this case, the open/close element 230 tends to close as a result of the force of gravity exerted thereon.

The embodiment of FIG. 4 can be taken as reference base for all the embodiments (which are not illustrated in any of the figures but can be readily imagined) having the reference axis comprised between the horizontal and the vertical.

In all these cases, the open/close element 230 tends to close as a result of the force of gravity exerted thereon.

Figure 5:
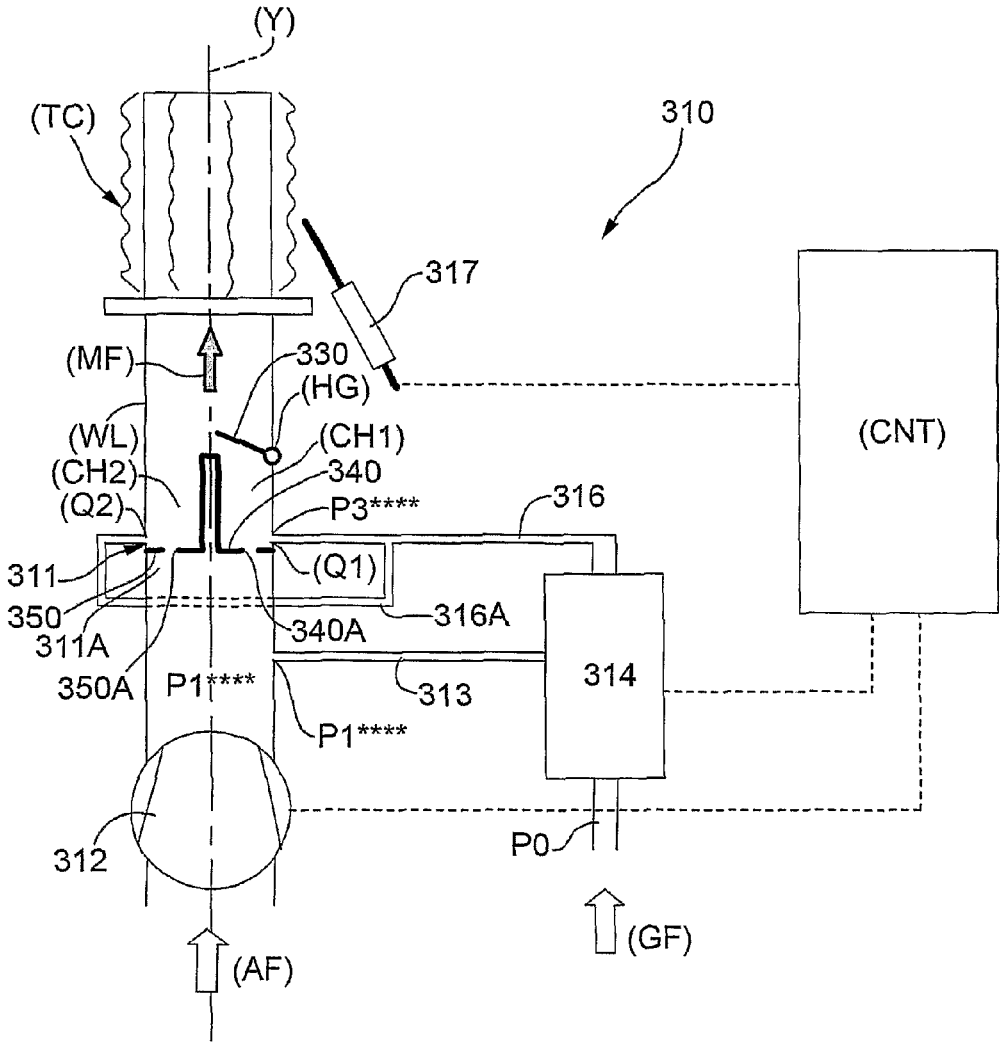
FIG. 5 is a schematic illustration of a third embodiment of the premix burner forming the subject of the present invention.

FIG. 5 illustrates a third embodiment in which an air/gas mixer 311 (with a localized-pressure-loss device 311A) envisages a respective diaphragm 340, 350 in a position corresponding to each channel (CH1), (CH2). In addition, each diaphragm 340, 350, in turn, has a respective central hole 340A, 350A that enables flow of the air pushed by the fan 312.

The two perforated diaphragms 340, 350 illustrated are also two areas of localized pressure loss for the air flow, which enable mixing with the gas coming from the conduit 316.

Once again, the channel (CH1) is provided with an open/close element 330 that closes the channel (CH1) itself with the modalities seen above.

The same conclusions are reached by replacing the hinged open/close elements 130, 230, 330 with the floating open/close elements (not illustrated in the attached figures).

In addition, the table appearing below presents a practical example, which sets in comparison the results obtained with the burner 10 represented in FIG. 1 (single. Venturi tube) with the burner 110 of FIG. 3 (double Venturi tube with a hinged open/close element):

TABLE

| | | | Invention Double-Venturi system | State of the art Single Venturi system |
|---|---|---|---|---|
| Geometrical Characteristics | Min. sect. of Venturi | $mm^2$ | 154.0 | 314.0 |
| | Outlet sect. of Venturi | $mm^2$ | 755.0 | 1 540.0 |
| | Weight of open/close element | g | 7.0 | — |
| | Gas-inlet holes | $N^o \times mm^2$ | 4 × 2.3 | 4 × 9.6 |
| | Flow regulator | $mm^2$ | — | 24.0 |
| Maximum thermal power (with open/close element fully open) | Burner thermal power | kW | 28.5 | 28.5 |
| | Air flowrate | $m^3/h$ | 34.3 | 34.3 |
| | Gas flowrate | $m^3/h$ | 3.05 | 3.05 |
| | (P1-P3) | Pa | 1 650 | 1 500 |
| Minimum thermal power (with open/close element fully closed) | Burner thermal power | kW | 6.2 | 6.2 |
| | Air flowrate | $m^3/h$ | 7.5 | 7.5 |
| | Gas flowrate | $m^3/h$ | 0.6 | 0.6 |
| | (P1-P3) | Pa | 145 | 48 |
| Minimum modulatable thermal power | Burner thermal power | kW | 2.0 | 5.0 |
| | Air flowrate | $m^3/h$ | 2.8 | 6.7 |
| | Gas flowrate | $m^3/h$ | 0.2 | 0.5 |
| | (P1-P3) | Pa | 35 | 35 |

As may be noted, in the traditional solution there is a modulation ratio of 1/5.7 (28.5 kW/5 kW=5.7) with a pneumatic signal to the gas valve of 35 Pa.

Instead, with the solution proposed in the present invention there is a ratio of 1/14.3 (28.5 kW/2.0 kW=14.3), maintaining the same pneumatic signal to the gas valve of 35 Pa.

The open/close element 130 closes completely at 6.2 kW with a pneumatic signal to the gas valve of 145 Pa.

Closing of the open/close element 130 is obviously gradual.

In the absence of open/close element 130, at that air flowrate, we shall have a pneumatic signal to the gas valve of just 48 Pa, close to the 35 Pa considered as the lower threshold not to be overstepped.

Indeed, it is possible to state that the opening of the channel (CH1) provided with open/close element 130 is never total since, on account of its own weight, it always tends to close the channel (CH1) itself.

The main advantage of the premix burner forming the subject of the present invention is to withstand variations of the thermal power that range from 100% to 10% and also to 5% of the nominal thermal power (from 10 to 20 times the minimum thermal power). Hence, as compared to traditional premix burners, the premix burner forming the subject of the present invention has a greater capacity of modulation of the thermal power so that it can reach very low values of said thermal power. This characteristic proves particularly useful when the premix burner forming the subject of the present invention is mounted on a combined boiler in which there is the need to modulate downwards the thermal power when just the function of heating of premises is activated.

What is claimed is:

1. A comburent/combustible-gas premix burner, comprising the following components:

ventilation means for sending the comburent and the comburent/combustible-gas mixture to a combustion head;

means for regulating the immission of the combustible gas;

a comburent/combustible-gas mixing system comprising means for localized pressure loss; and a combustion head, provided with a device for ignition of the comburent/combustible-gas mixture and for detection of the presence of the flame;

wherein said mixing system is divided into two mixing channels for mixing the comburent with the combustible gas, wherein the two mixing channels are in fluid communication via a reverse flow extending between the two mixing channels, and wherein only one of the mixing channels is provided with open/close means designed to regulate the flowrate of the mixture through said two channels;

wherein said mixing system is divided into said mixing channels by a baffle element, the baffle element being shaped in such a way as to bestow upon each mixing channel a shape of a Venturi tube such that the inlets to each of the Venturi tubes are subject to the same inlet pressure;

wherein said open/close means envisages weight and shape adequate for opening the passage for air, or for the air/gas mixture, at values of pressure difference higher than a preset minimum;

wherein a force generated by the pressure difference acts against a weight of the open/close means alone; and wherein, when the open/close means are completely closed, a negligible air flow is determined in the reverse flow conduit connecting the mixing channels.

2. The premix burner according to claim 1, characterized in that said mixing system has a vertical axis.

3. The premix burner according to claim 1, characterized in that said mixing system has a horizontal axis.

4. The premix burner according to claim 1, characterized in that said mixing system has an axis inclined by any desired amount with respect to a horizontal axis or vertical axis.

5. The premix burner according to claim 1, characterized in that said open/close means move during opening under the thrust of the fluids (air or air/gas mixture), and reclose automatically thanks to their own weight during closing.

6. The premix burner according to claim 5, characterized in that said open/close means are hinged to a hinge fixed to a wall.

7. The premix burner according to claim 5, characterized in that said open/close means comprise a floating open/close element such that the movement upwards is completely free and guided uniquely by the fluid-dynamic thrust of the fluid passing through.

8. The premix burner according to claim 1, characterized in that the dimensions of the minimum sections of the channels for mixing of the fluids are the same as one another so as to generate, given the same flow of air passing through, the same pressure difference.

9. The premix burner according to claim 1, characterized in that the dimensions of the minimum sections of channels for mixing of the fluids are different so as to generate, given the same flow of air passing through, a different and preset pressure difference.

10. The premix burner according to claim 1, characterized in that it envisages gas-inlet sections in the mixing system; said gas-inlet sections being configured in such a way as to provide the fluid-dynamic resistance necessary for obtaining the proper air/gas ratio.

* * * * *